US009227811B2

(12) United States Patent
Yamada et al.

(10) Patent No.: US 9,227,811 B2
(45) Date of Patent: Jan. 5, 2016

(54) IMAGE FORMING APPARATUS

(71) Applicant: FUJI XEROX CO., LTD., Minato-ku, Tokyo (JP)

(72) Inventors: Akihiro Yamada, Kanagawa (JP); Hiroshi Kawamoto, Kanagawa (JP); Hidekazu Yamagiwa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 62 days.

(21) Appl. No.: 13/888,823

(22) Filed: May 7, 2013

(65) Prior Publication Data

US 2014/0103605 A1 Apr. 17, 2014

(30) Foreign Application Priority Data

Oct. 12, 2012 (JP) ..... 2012-226511

(51) Int. Cl.

| | |
|---|---|
| ***B65H 31/26*** | (2006.01) |
| ***B65H 29/20*** | (2006.01) |
| ***B65H 29/70*** | (2006.01) |
| ***B65H 29/14*** | (2006.01) |

(52) U.S. Cl.

CPC ..... *B65H 29/20* (2013.01); *B65H 29/14* (2013.01); *B65H 29/70* (2013.01); *B65H 31/26* (2013.01); *B65H 2301/5133* (2013.01); *B65H 2401/211* (2013.01); *B65H 2404/60* (2013.01); *B65H 2404/61* (2013.01); *B65H 2404/63* (2013.01); *B65H 2405/113* (2013.01); *B65H 2601/261* (2013.01); *B65H 2801/06* (2013.01)

(58) Field of Classification Search

CPC ..... B65H 29/00; B65H 29/20; B65H 29/22; B65H 29/70; B65H 31/00; B65H 2404/50; B65H 2404/51; B65H 2404/511; B65H 2404/512; B65H 2404/54; B65H 2404/60; B65H 2404/61; B65H 2404/6111; B65H 2404/6112; B65H 2404/612; B65H 2404/63; B65H 2404/65; B65H 29/58; B65H 29/38; B65H 29/40

USPC ..... 271/207–209, 220

See application file for complete search history.

(56) References Cited

U.S. PATENT DOCUMENTS

| | | | | | |
|---|---|---|---|---|---|
| 4,300,757 | A * | 11/1981 | Koiso et al. | ..... | 271/207 |
| 5,014,976 | A * | 5/1991 | Muck et al. | ..... | 271/220 |
| 5,249,793 | A * | 10/1993 | Scheufler | ..... | 271/220 |
| 5,478,061 | A * | 12/1995 | Murakami et al. | ..... | 270/58.08 |
| 6,408,147 | B1 * | 6/2002 | Oshida | ..... | 399/82 |
| 7,237,774 | B2 * | 7/2007 | Fukatsu et al. | ..... | 271/207 |
| 8,087,666 | B2 * | 1/2012 | Honda et al. | ..... | 271/220 |

(Continued)

FOREIGN PATENT DOCUMENTS

| | | | | | |
|---|---|---|---|---|---|
| JP | 63060863 | A * | 3/1988 | ..... | B65H 29/70 |
| JP | 02233451 | A * | 9/1990 | ..... | B65H 29/54 |
| JP | 04089763 | A * | 3/1992 | ..... | B65H 31/26 |
| JP | 2005-075565 | A | 3/2005 | | |

*Primary Examiner* — Prasad Gokhale

(74) *Attorney, Agent, or Firm* — Sughrue Mion, PLLC

(57) ABSTRACT

An image forming apparatus includes an output unit that transports and outputs a recording medium on which an image has been formed, a member having an opening through which the recording medium is output, and a shield member disposed at the opening, the shield member shielding the output unit. The shield member includes plural swing members and a shield plate. The swing members are swingably supported and arranged in an axial direction of the output unit. The shield plate is attached to a wall that restrains the recording medium that is output from returning toward the output unit.

8 Claims, 7 Drawing Sheets

(56) References Cited

U.S. PATENT DOCUMENTS

| | | | | |
|---|---|---|---|---|
| 2003/0160385 | A1* | 8/2003 | Furusawa | 271/220 |
| 2004/0156032 | A1* | 8/2004 | Murakami et al. | 355/407 |
| 2006/0237900 | A1* | 10/2006 | Sekiyama et al. | 271/220 |
| 2009/0212486 | A1* | 8/2009 | Kramer | 271/217 |
| 2009/0212487 | A1* | 8/2009 | Okamoto et al. | 271/220 |
| 2009/0295061 | A1* | 12/2009 | Honda et al. | 271/3.14 |
| 2010/0254721 | A1* | 10/2010 | Fukita et al. | 399/44 |
| 2014/0239578 | A1* | 8/2014 | Honda et al. | 271/217 |

* cited by examiner

IMAGE FORMING APPARATUS

CROSS-REFERENCE TO RELATED APPLICATIONS

This application is based on and claims priority under 35 USC 119 from Japanese Patent Application No. 2012-226511 filed Oct. 12, 2012.

BACKGROUND

Technical Field

The present invention relates to an image forming apparatus.

SUMMARY

According to an aspect of the invention, an image forming apparatus includes an output unit that transports and outputs a recording medium on which an image has been formed, a member having an opening through which the recording medium is output, and a shield member disposed at the opening, the shield member shielding the output unit. The shield member includes plural swing members and a shield plate. The swing members are swingably supported and arranged in an axial direction of the output unit. The shield plate is attached to a wall that restrains the recording medium that is output from returning toward the output unit.

BRIEF DESCRIPTION OF THE DRAWINGS

An exemplary embodiment of the present invention will be described in detail based on the following figures, wherein.

DETAILED DESCRIPTION

Figure 1:
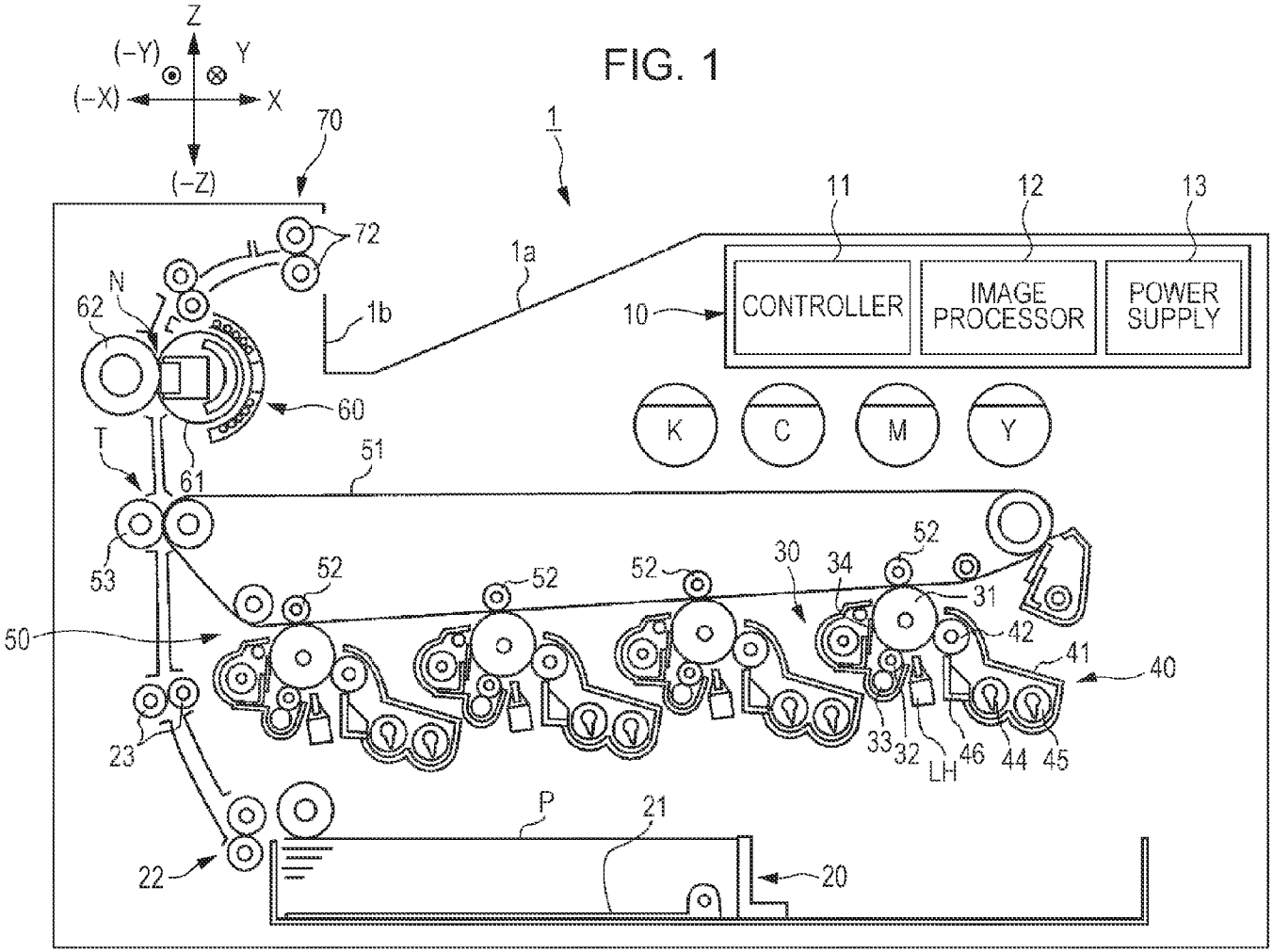
FIG. 1 is a sectional schematic view illustrating the internal structure of an image forming apparatus according to the exemplary embodiment.

Hereinafter, an exemplary embodiment of the present invention will be described in detail with reference to the drawings. The present invention is not limited to the exemplary embodiment.

The drawings are schematic, the proportions of the dimensions of members of the apparatus illustrated in the drawings are not the same as those of actual members, and members that are not necessary for the description are omitted.

For ease of understanding the following description, the front-back direction in the drawings will be referred to as the X-axis direction, the left-right direction will be referred to as the Y-axis direction, and the vertical direction will be referred to as the Z-axis direction.

(1) Overall Structure and Operation of Image Forming Apparatus

FIG. 1 is a sectional schematic view illustrating the internal structure of an image forming apparatus 1 according to the present exemplary embodiment.

The overall structure and the operation of the image forming apparatus 1 will be described with reference to the drawings.

The image forming apparatus 1 includes a control device 10, a sheet feeder 20, photoconductor units 30, developing devices 40, a transfer device 50, a fixing device 60, and a sheet output device 70. An output tray 1*a* is formed on an upper surface (facing in the Z direction) of the image forming apparatus 1. A sheet P on which an image has been recorded is output to and stacked on the output tray 1*a*.

The control device 10 includes a controller 11 that controls the operation of the image forming apparatus 1, an image processor 12 that is controlled by the controller 11, a power supply 13, and the like. The power supply 13 supplies voltages to charging rollers 32, developing rollers 42, first transfer rollers 52, a second transfer roller 53, and the like, which will be described below.

The image processor 12 converts print information that is input from an external information transmitting device (such as a personal computer) into image information for forming a latent image, and outputs driving signals to exposure devices LH at predetermined timings. In the present exemplary embodiment, each of the exposure devices LH is an LED head in which light emitting diodes (LEDs) are linearly arranged.

The sheet feeder 20 is disposed in a bottom portion of the image forming apparatus 1. The sheet feeder 20 includes a sheet stack plate 21, on which sheets P, each of which is an example of a recording medium, are stacked. Regulation plates (not shown) regulate the positions of the sheets P, which are stacked on the sheet stack plate 21, in the width direction. A pick-up unit 22 picks up the sheets P one by one from the top of the stack, and feeds the picked up sheet P forward (in the −X direction). Then, the sheet P is transported to a nip portion of a registration roller pair 23.

The photoconductor units 30 are disposed side by side above (in the Z direction from) the sheet feeder 20. The photoconductor units 30 each include a photoconductor drum 31, which is an example of an image carrier that rotates. Around each photoconductor drum 31 in the rotation direction, the charging roller 32, the exposure device LH, the developing device 40, the first transfer roller 52, and a cleaning blade 34 are arranged. A cleaning roller 33, which cleans a surface of the charging roller 32, is disposed so as to face and contact the charging roller 32.

The developing device 40 includes a development housing 41 in which a developer is contained. The developing roller 42 and a pair of augers 44 and 45 are disposed in the development housing 41. The developing roller 42 is disposed so as to face the photoconductor drum 31. The augers 44 and 45, which are disposed behind and diagonally below the developing roller 42, agitate and transport the developer toward the developing roller 42. A layer regulation member 46, which is disposed near the developing roller 42, regulates the layer thickness of the developer.

The developing devices 40 are substantially the same except that the colors of the developers contained in the development housings 41 are different. The developing devices 40 respectively form yellow (Y), magenta (M), cyan (C), and black (K) toner images.

The charging roller 32 charges the surface of the photoconductor drum 31, which rotates. The exposure device LH emits latent-image-forming light that forms an electrostatic latent image on the surface of the photoconductor drum 31. The developing roller 42 develops the electrostatic latent image, which has been formed on the photoconductor drum 31, thereby forming a toner image.

The transfer device 50 includes an intermediate transfer belt 51 and the first transfer rollers 52. Color toner images, which have been formed on the photoconductor drums 31 of the photoconductor units 30, are transferred to the intermediate transfer belt 51 so as to overlap each other. The first transfer rollers 52 successively transfer (first-transfer) the color toner images, which have been formed by the photoconductor units 30, to the intermediate transfer belt 51. The transfer device 50 further includes the second transfer roller 53, which simultaneously transfers (second-transfers) the color toner images, which have been transferred to the intermediate transfer belt 51, to the sheet P, which is an example of a recording medium.

The power supply 13, which is controlled by the controller 11, or the like supplies a predetermined first-transfer voltage to the first transfer rollers 52. The first transfer rollers 52 successively and electrostatically transfer (first-transfer) the color toner images, which have been formed on the photoconductor drums 31 of the photoconductor units 30, to the intermediate transfer belt 51. As a result, the color toner images overlap each other, thereby forming overlapping toner images.

As the intermediate transfer belt 51 moves, the overlapping toner images on the intermediate transfer belt 51 are transported to a region in which the second transfer roller 53 is disposed (second-transfer region T). At the time at which the overlapping toner images are transported to the second-transfer region T, a sheet P is supplied to the second-transfer region T from the sheet feeder 20. The power supply 13, which is controlled by the controller 11, or the like supplies a predetermined second-transfer voltage to the second transfer roller 53. The second transfer roller 53 simultaneously transfers the overlapping toner images on the intermediate transfer belt 51 to the sheet P, which has been fed by the registration roller pair 23 and guided by transport guides.

The cleaning blade 34 removes residual toner from the surface of the photoconductor drum 31, and the residual toner is recovered to a waste toner container (not shown). The charging roller 32 recharges the surface of the photoconductor drum 31. The cleaning roller 33, which rotates while being in contact with the charging roller 32, wipes residual matters that have not been removed by the cleaning blade 34 and have adhered to the charging roller 32 off the charging roller 32, and the residual matters are accumulated.

The fixing device 60 includes a fixing belt 61 and a press roller 62. The fixing belt 61 is an endless belt that rotates in one direction. The press roller 62 is in contact with a peripheral surface of the fixing belt 61 and rotates in one direction. A nip portion N (fixing region) is formed in a region in which the fixing belt 61 and the press roller 62 are pressed against each other.

The sheet P, to which the transfer device 50 has transferred a toner image, is transported to the fixing device 60 via the transport guides before the toner image is fixed. The fixing belt 61 and the press roller 62 apply pressure and heat to the sheet P, which has been transported to the fixing device 60, so that a toner image is fixed onto the sheet P.

Transport guides 71*a* and 71*b* of the sheet output device 70 guide the sheet P, on which a fixed toner image has been formed. An output roller pair 72 outputs the sheet P to the output tray 1*a* on the upper surface of the image forming apparatus 1.

(2) Structure and Operation of Output Device

Figure 2:
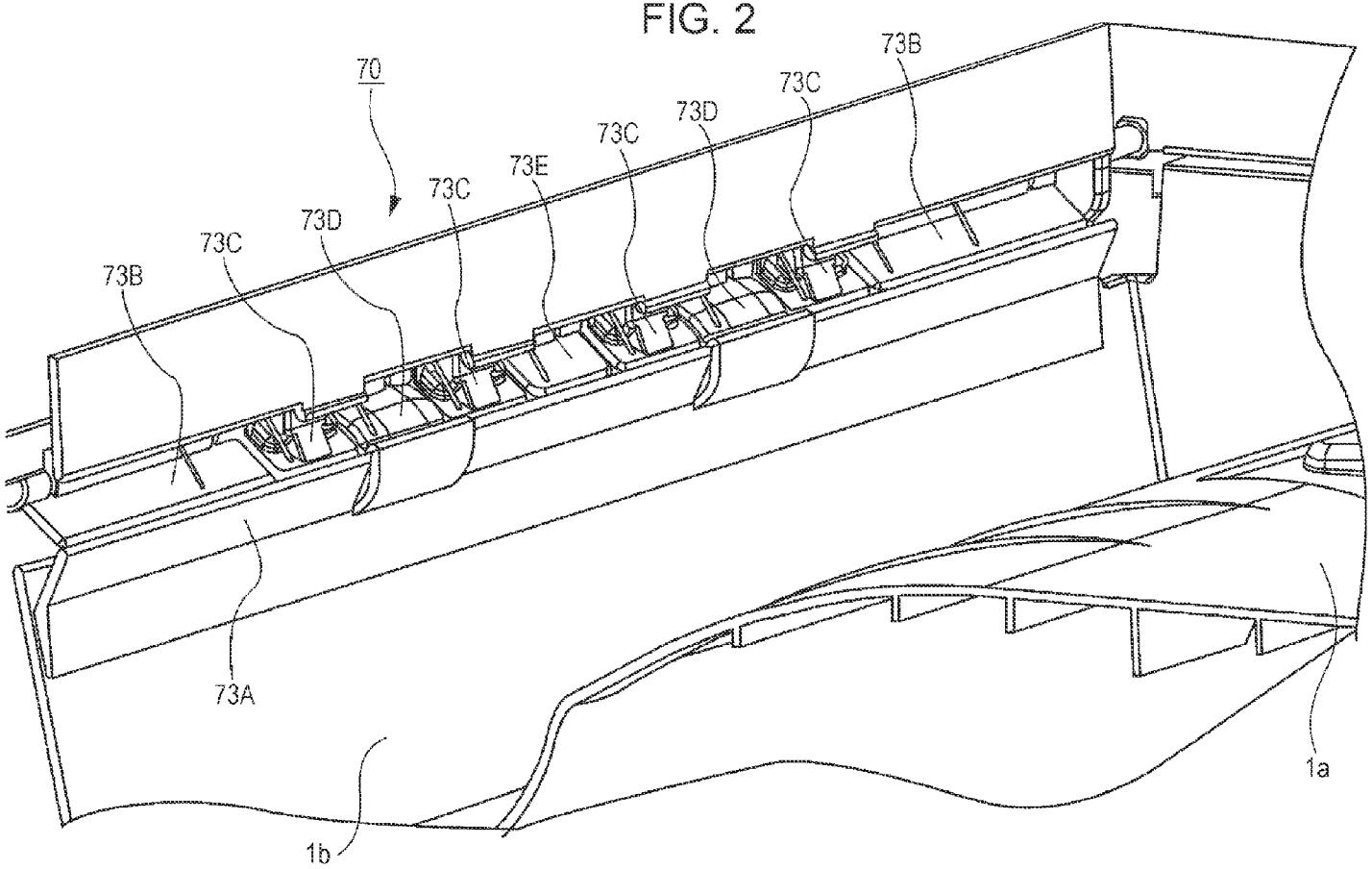
FIG. 2 is a perspective view of a sheet output device of a sheet output section of the image forming apparatus, seen from the output side, in a state in which a sheet output operation is not performed (flap-closed state).
Figure 3:
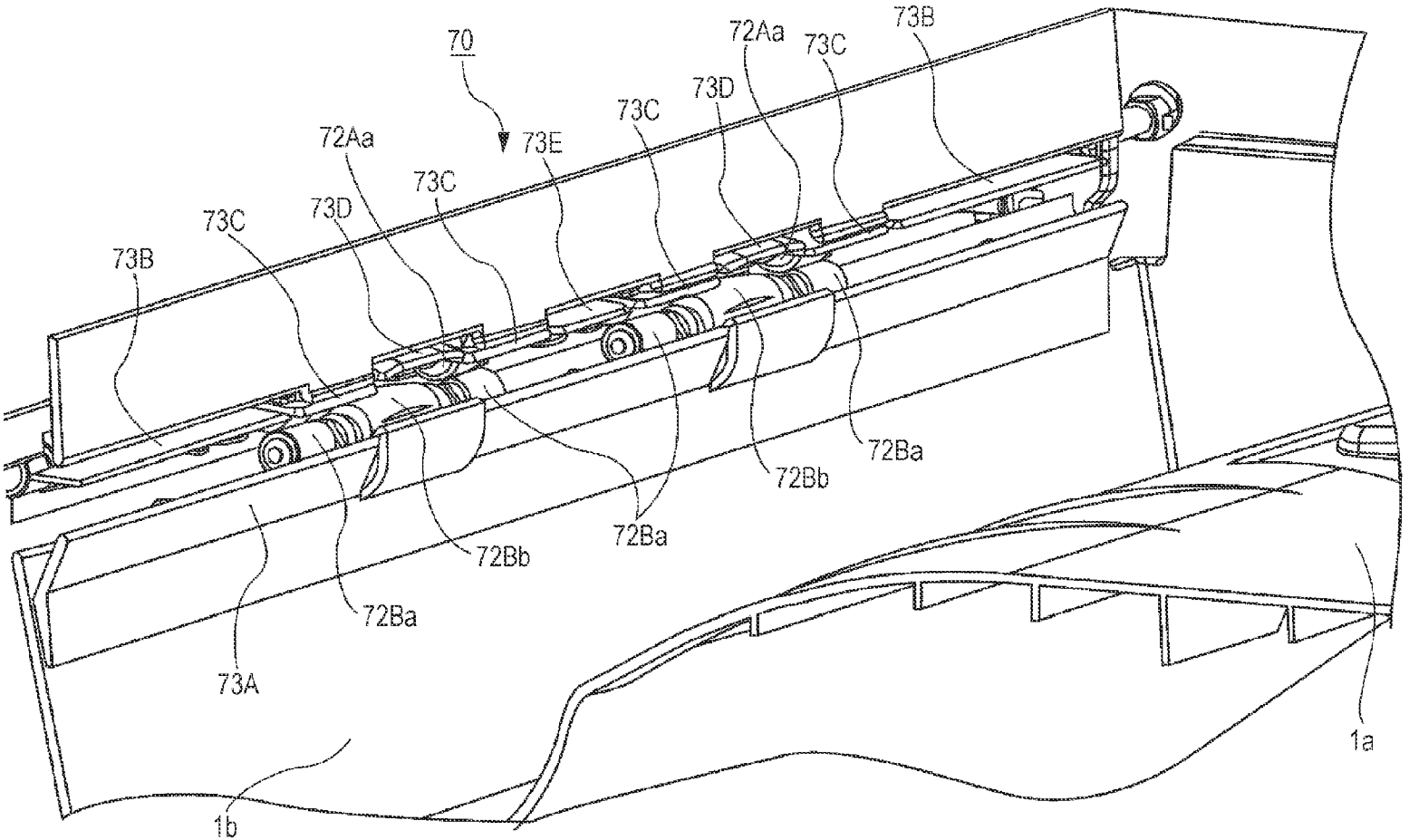
FIG. 3 is a perspective view of the sheet output device of the sheet output section of the image forming apparatus, seen from the output side, in a state in which a sheet output operation is performed (flap-open state)
Figure 4A:
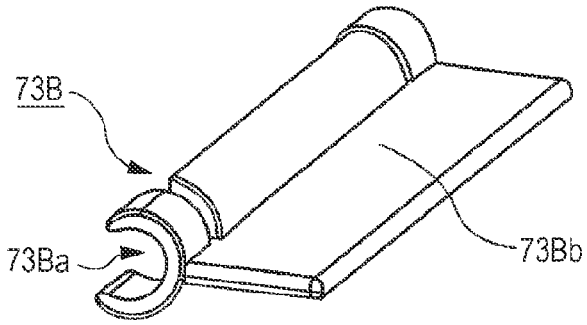
FIGS. 4A to 4D are perspective views of flaps of plural types.
Figure 4B:
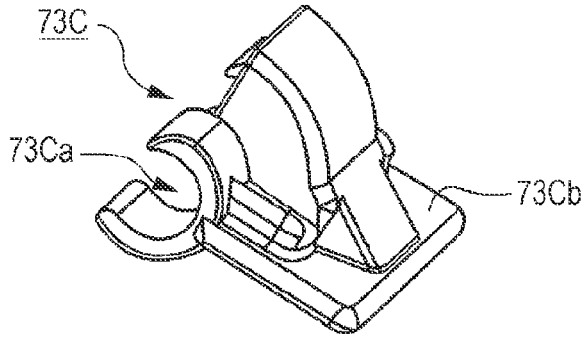
Figure 4C:
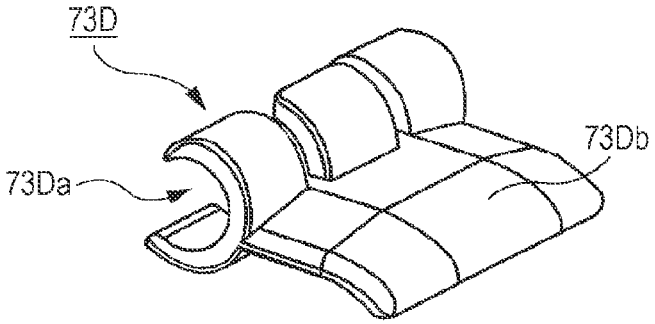
Figure 4D:
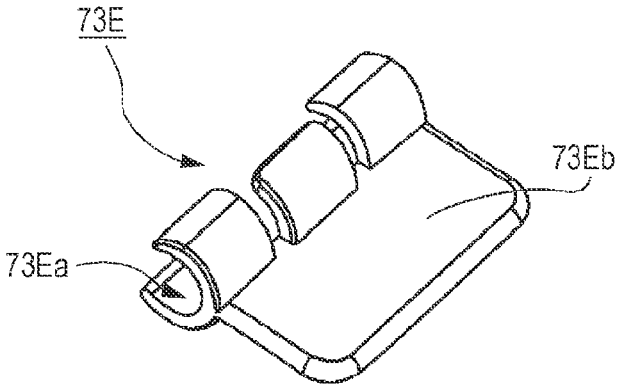
Figure 5A:
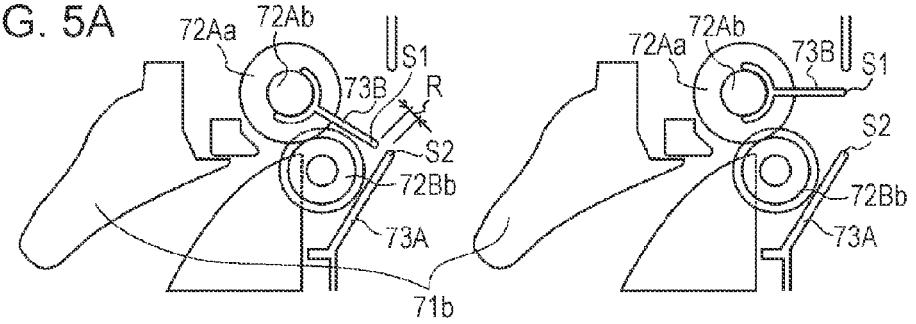
FIGS. 5A to 5D are schematic longitudinal sectional views illustrating the flaps and an output roller pair in overlapping states.
Figure 5B:
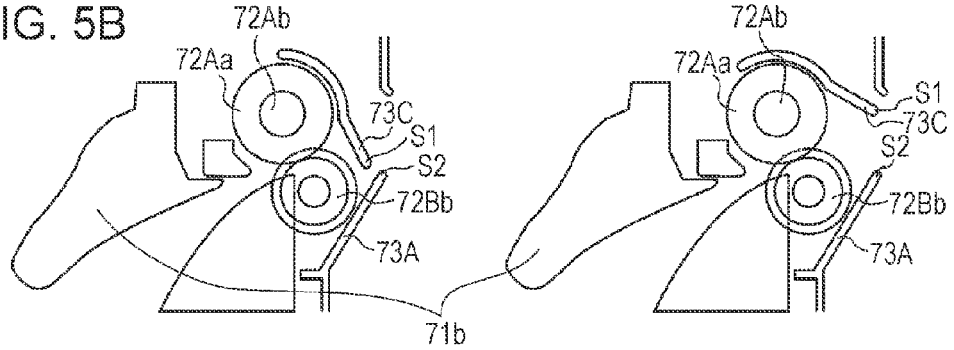
Figure 5C:
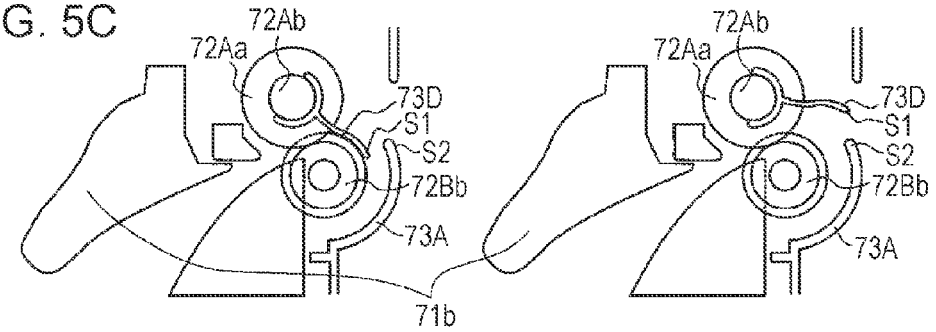
Figure 5D:
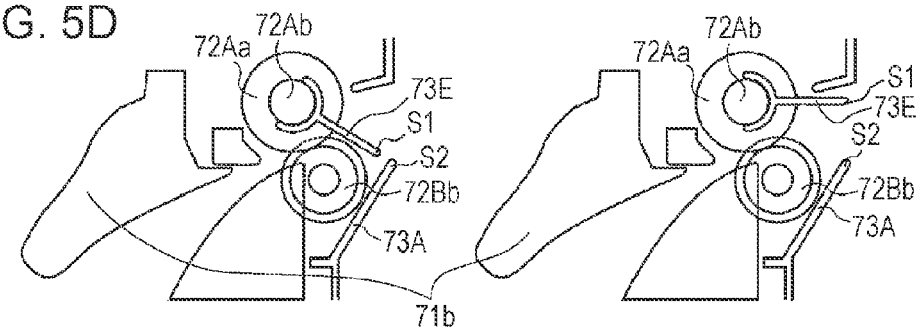
Figure 8:
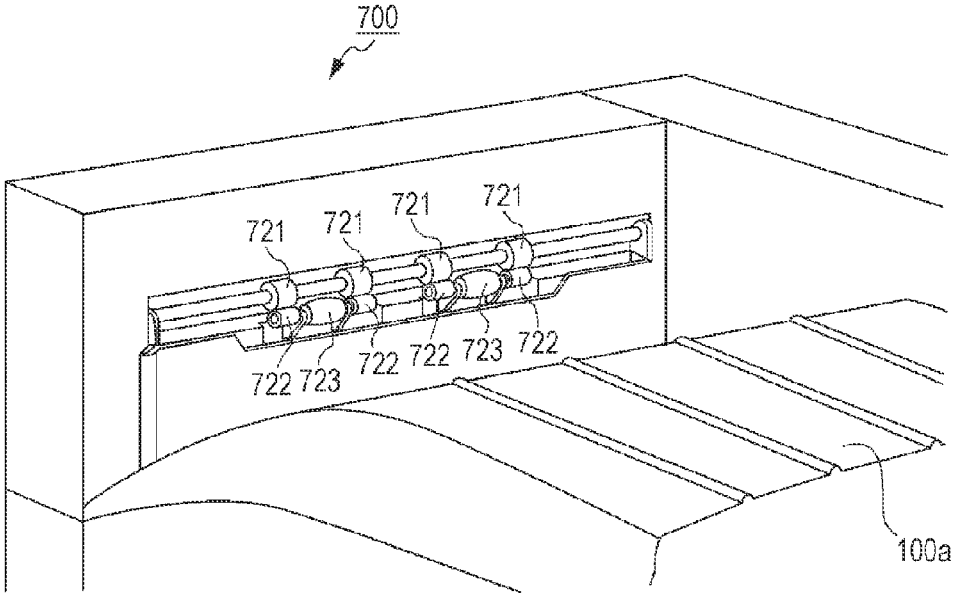
FIG. 8 is a perspective view of a sheet output section of an image forming apparatus according to a comparative example, seen from the output side.

FIG. 2 is a perspective view of the sheet output device 70 of a sheet output section of the image forming apparatus 1, seen from the output side, in a state in which a sheet output operation is not performed (flap-closed state). FIG. 3 is a perspective view of the sheet output device 70 in a state in which a sheet output operation is performed (flap-open state). FIG. 8 is a perspective view of a sheet output section of an image forming apparatus 100 according to a comparative example, seen from the output side.

(2.1) Output Device According to Comparative Example

Before describing the structure of the sheet output device 70 according to the present exemplary embodiment, a problem with the image forming apparatus 100 according to a comparative example, in which a shield member is not disposed at an opening in a sheet output section, will be described.

In the image forming apparatus 100, the sheets P on which toner images have been formed are stacked on an output tray 100*a*. A user may take the sheets P from the front side of the image forming apparatus 100.

An opening is formed in a sheet output device 700, and an output roller pair 720 outputs a sheet on which a toner image has been formed by a fixing device (not shown, the same as the fixing device 60 in FIG. 1) to the output tray 100*a* through the opening.

The output roller pair 720 includes drive rollers 721 that are rotated, pinch rollers 722 that are rotatably pressed against the drive rollers 721, corrugation rollers 723 that are disposed between the pinch rollers 722. When the output roller pair 720 rotates, the sheet P is output to the output tray 100*a*.

Figure 7:
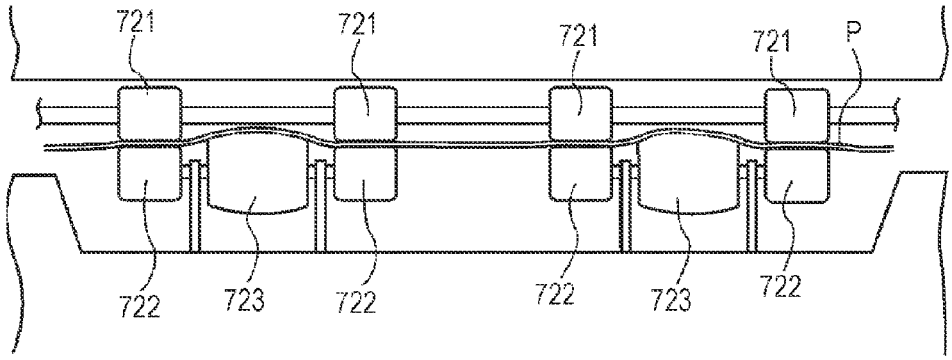
FIG. 7 is a schematic view illustrating corrugation of a sheet formed by an output roller pair.

As schematically illustrated in FIG. 7, the output roller pair 720 has a corrugation section that forms plural vertical recesses, which extend in the output direction of the sheet P that is output, in the sheet P in order to increase the stiffness of the sheet P and improve the transport stability of the sheet P.

To be specific, middle portions of the corrugation rollers 723, which are disposed between the pinch rollers 722, have outside diameters that are larger than those of the pinch rollers 722. With such a structure, a wave-like shape is formed in a direction perpendicular to the output direction when the sheet P is output, and thereby the stiffness of the sheet P is increased.

Because of this configuration, the opening in the sheet output device 700 has a dimension in the vertical direction such that peaks and valleys of the wave-shaped portion of the sheet P do not contact the upper and lower edges of the opening. The opening is open irrespective of whether a sheet output operation is being performed. Therefore, a foreign object may enter the image forming apparatus through the opening and may cause damage to internal devices such as the fixing device 60, or may cause paper jam.

(2.2) Sheet Output Device According to Exemplary Embodiment

The sheet output device 70 according to the present exemplary embodiment includes the transport guides 71*a* and 71*b*, the output roller pair 72, and a shield cover 73. The transport guides 71*a* and 71*b* guide the sheet P, onto which the fixing device 60 has fixed a toner image, to the output roller pair 72. The output roller pair 72 is rotated by a driving source (not shown).

(2.2.1) Output Roller Pair

The output roller pair 72 includes a drive roller 72A and an output roller 72B. The output roller pair 72 outputs the sheet P, onto which the fixing device 60 has fixed a toner image, to the outside of the apparatus while deforming the sheet P so that the cross section of the sheet P in the width direction has a wave-like shape.

The drive roller 72A includes a shaft 72Ab and plural individual rollers 72Aa. The shaft 72Ab extends in the width direction of the sheet P. The individual rollers 72Aa are cylindrical rollers that are arranged in the width direction of the sheet P with distances therebetween. The shaft 72Ab is rotatably supported by side panels of the sheet output device 70 and rotated by a driving source (not shown) such as a motor.

The output roller 72B includes pinch rollers 72Ba and corrugation rollers 72Bb. The pinch rollers 72Ba are rotatably pressed against the individual rollers 72Aa. The corrugation rollers 72Bb are disposed between the pinch rollers 72Ba so as to be rotatable.

The outside diameter of middle portions of the corrugation rollers 72Bb is larger than the outside diameter of the pinch rollers 72Ba. The corrugation rollers 72Bb form corrugation (wave-like shape) of the sheet P at nip portions between the individual rollers 72Aa and the pinch rollers 72Ba when seen in a direction perpendicular to the width direction of the sheet P.

The output roller 72B is disposed below the drive roller 72A so as to face the drive roller 72A. The drive roller 72A and the output roller 72B constitute the output roller pair 72.

(2.3) SHIELD COVER

The shield cover 73 includes an end cover 73A and flaps 73B, 73C, 73D, and 73E of plural types. The flaps 73B to 73E are examples of swing members. The shield cover 73 is disposed on the output side (outward from) the output roller pair 72 so as to cover the output roller pair 72 when a sheet output operation is not performed.

The shield cover 73A is attached to a wall 1*b*. The wall 1*b* is integrally formed with the output tray 1*a* and is disposed on the output side below the output roller pair 72 (in the −Z direction). The wall 1*b* restrains the sheet P that is output from returning toward the output roller pair 72.

The flaps 73B, 73C, 73D, and 73E of plural types are disposed on the output side above the output roller pair 72 (in the Z direction) so as to be swingable around the shaft 72Ab of the drive roller 72A.

(2.3.1) Flaps

FIGS. 4A to 4D are perspective views of the flaps 73B, 73C, 73D, and 73E of plural types. FIGS. 5A to 5D are schematic longitudinal sectional views illustrating the flaps 73B to 73E and the output roller pair 72 in overlapping states.

As illustrated in FIGS. 4A to 4D, the flaps 73B, 73C, 73D, and 73E respectively include cylindrical portions 73Ba, 73Ca, 73Da, and 73Ea, each having a cutout portion; and flap portions 73Bb, 73Cb, 73Db, and 73Eb, which are formed on the outer surfaces of the cylindrical portions 73Ba, 73Ca, 73Da, and 73Ea.

The flap portions 73Bb, 73Cb, 73Db, and 73Eb of the flaps 73B, 73C, 73D, and 73E respectively have shapes that correspond to openings between the end cover 73A and both end portions of the shaft 72Ab of the output roller pair 72, openings at the nip portions between the individual rollers 72Aa and the pinch rollers 72Ba, openings between the shaft 72Ab and the corrugation rollers 72Bb, and an opening between the end cover 73A and a middle portion of the shaft 72Ab.

As illustrated in FIGS. 4A to 4D, the cylindrical portions 73Ba, 73Ca, 73Da, and 73Ea of the flaps 73B, 73C, 73D, and 73E each have a sectional shape having a cutout portion. The flaps 73B to 73E are snap fitted to the shaft 72Ab of the drive roller 72A while elastically deforming the cutout portion so that the flaps 73B to 73E are swingable around the rotary shaft of the drive roller 72A.

The flaps 73B are disposed so as to face the shaft 72Ab of the drive roller 72A. When a sheet output operation is not performed, the flaps 73B overlap the tip portion S2 of the end cover 73A and shield the openings below the shaft 72Ab of the drive roller 72A (see FIG. 5A).

The flaps 73C are disposed so as to face the nip portions between the individual rollers 72Aa and 72Aa of the drive roller 72A and the pinch rollers 72Ba and 72Ba. When a sheet output operation is not performed, the flaps 73C overlap the tip portion S2 of the end cover 73A and shield the openings at the nip portions between the individual rollers 72Aa and 72Aa of the drive roller 72A and pinch rollers 72Ba and 72Ba (see FIG. 5B).

The flaps 73D are disposed so as to face the corrugation rollers 72Bb. When a sheet output operation is not performed, the flaps 73D overlap the tip portion S2 of the end cover 73A and shield the openings between the shaft 72Ab of the drive roller 72A and the corrugation rollers 72Bb (see FIG. 5C).

The flap 73E is disposed so as to face the shaft 72Ab of the drive roller 72A. When a sheet output operation is not performed, the flap 73E overlaps the tip portion S2 of the end cover 73A and shields the opening below the shaft 72Ab of the drive roller 72A (see FIG. 5D).

When a sheet output operation is being performed, because the flaps 73B, 73C, 73D, and 73E are swingable around the shaft 72Ab of the drive roller 72A, the flaps 73B to 73E are pushed up by the leading end of the sheet P and an opening having a shape corresponding to the corrugated shape of the sheet P is formed between the flaps 73B to 73E and the tip portion S2 of the end cover 73A.

That is, the flaps 73B, 73C, 73D, and 73E are disposed separately at positions respectively corresponding to both end portions of the shaft 72Ab of the drive roller 72A, the individual rollers 72Aa, the corrugation rollers 72Bb, and the middle portion of the shaft 72AB of the drive roller 72A of the output roller pair 72. Moreover, the flaps 73B, 73C, 73D, and 73E respectively have shapes corresponding to the shapes of the openings formed at these positions. Therefore, a resisting force that the sheet P receives from the flaps 73B, 73C, 73D, and 73E is reduced, and it is possible to output the sheet P while maintaining the stiffness of the sheet P provided by the output roller pair 72.

When a sheet output operation is not performed, tip portions S1 of the flaps 73B, 73C, 73D, and 73E overlap the tip portion S2 of the end cover 73A, when seen in a direction perpendicular to the width direction of the sheet P. The distance R (see FIG. 5A) from the tip portion S1 of each of the flaps 73B, 73C, 73D, and 73E to the tip portion S2 of the end cover 73A is smaller than or equal to 5 mm.

Accordingly, it is possible to suppress entry of a foreign object through the opening and to prevent damage to internal devices, such as the fixing device 60, and occurrence of paper jam.

The material of the flaps 73B, 73C, 73D, and 73E is not particularly limited. For example, the cylindrical portions 73Ba, 73Ca, 73Da, and 73Ea; and the flap portions 73Bb, 73Cb, 73Db, and 73Eb, which have plate-like shapes, may be integrally formed by injection molding an electroconductive resin.

The shaft 72Ab of the drive roller 72A is made of a metal and the cylindrical portions 73Ba, 73Ca, 73Da, and 73Ea are snap fitted to the shaft 72Ab so as to be swingable. As a result, even when the sheets P that are output have been charged, the sheets P are neatly stacked on the output tray 1*a* because the flaps 73B, 73C, 73D, and 73E remove static charges from the sheets P.

(3) Operation

Figure 6:
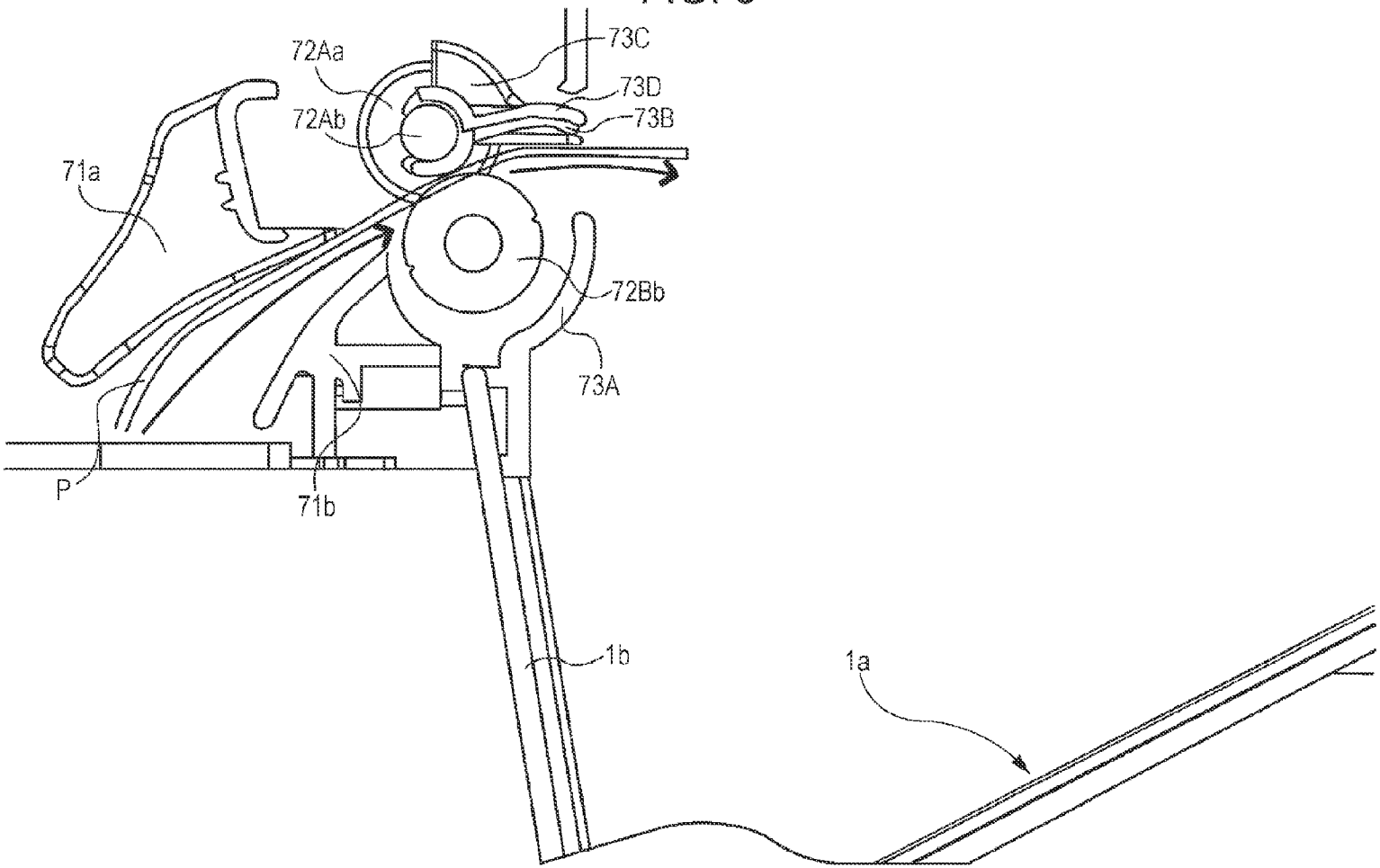
FIG. 6 is a schematic longitudinal sectional view of the sheet output device of the sheet output section of the image forming apparatus.

FIG. 6 is a schematic longitudinal sectional view of the sheet output device 70.

The sheet output device 70 according to the present exemplary embodiment outputs the sheet P, onto which the fixing device 60 has fixed a toner image, to the output tray 1*a* using the output roller pair 72. In a state in which a sheet output operation is not performed (flap-closed state), the upper side of the opening in the sheet output device 70 is covered by the flaps 73B, 73C, 73D, and 73E of plural types, which face the output roller pair 72 from the output side and cover the output roller pair 72.

On the lower side of the opening in the sheet output device 70, the end cover 73A is attached to the wall 1*b*. The wall 1*b*, which is integrally formed with the output tray 1*a*, restrains the sheet P that is output from returning toward the output roller pair 72.

Therefore, when seen in a direction perpendicular to the width direction of the sheet P, the tip portions S1 of the flaps 73B, 73C, 73D, and 73E overlap the tip portion S2 of the end cover 73A. Accordingly, it is possible to suppress entry of a foreign object through the opening and to prevent damage to internal devices, such as the fixing device 60, and occurrence of paper jam.

The flaps 73B, 73C, 73D, and 73E of plural types, which cover the output roller pair 72, are disposed separately at positions respectively corresponding to both end portions of the shaft 72Ab of the drive roller 72A, the individual rollers 72Aa, the corrugation rollers 72Bb, and the middle portion of the shaft 72AB of the drive roller 72A of the output roller pair 72. Moreover, the flaps 73B, 73C, 73D, and 73E respectively have shapes corresponding to the shapes of the openings formed at these positions.

The flaps 73B, 73C, 73D, and 73E are swingable around the shaft 72Ab of the drive roller 72A.

Therefore, a resisting force that the sheet P receives from the flaps 73B, 73C, 73D, and 73E is reduced, and it is possible to output the sheet P while maintaining the stiffness of the sheet P provided by the output roller pair 72.

The flaps 73B, 73C, 73D, and 73E respectively include the cylindrical portions 73Ba, 73Ca, 73Da, and 73Ea, which are snap fitted to the shaft 72Ab of the drive roller 72A; and the flap portions 73Bb, 73Cb, 73Db, and 73Eb, which have plate-like shapes and cover the output roller pair 72. The cylindrical portions 73Ba to 73Ea and the flap portions 73Bb to 73Eb are respectively integrally formed and are made of an electroconductive material.

After a toner image has been fixed onto the sheet P by the fixing device 60, the sheet P passes the transport guides 71*a* and 71*b* and is output from the output roller pair 72 while the upper surface of the sheet P is in contact with the flap portions 73Bb, 73Cb, 73Db, and 73Eb, and thereby static charge on the sheet P is removed through the shaft 72Ab of the drive roller 72A, to which the flaps 73B to 73E are snap fitted. As a result, the sheets P are neatly stacked on the output tray 1*a*.

In the present exemplary embodiment, the image forming apparatus 1 is a color printer using an electrophotographic method. The present invention may be applied to another image forming apparatus, such as a copier, a facsimile machine, or a multifunctional machine; an image forming apparatus using a method other than the electrophotographic method, such as an inkjet method; and an output device connected to such an image forming apparatus or to another sheet handling device.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an output unit that transports and outputs a recording medium on which an image has been formed, the output unit comprises a drive roller that includes a rotary shaft and a roller supported by the rotary shaft;

a member having an opening through which the recording medium is output; and a shield member disposed at the opening, the shield member shielding the output unit, wherein the shield member includes a plurality of swing members and a cover, the swing members being swingably supported and arranged in an axial direction of the output unit, the cover being attached to a wall that restrains the recording medium that is output from returning toward the output unit, wherein the swing members overlap with the roller when viewed from a transport direction of the recording medium and include different types of swing members, wherein the drive roller that includes a plurality of rollers that are supported by the rotary shaft, and the plurality of swing members are swingably engaged with the rotary shaft of the drive roller.

2. The image forming apparatus according to claim 1, wherein the swing members swing when the swing members are pushed by the recording medium that is output by the output unit, and tip portions of the swing members are covered by the cover when the swing members are at rest under weights thereof before the swing members are pushed by the recording medium and swing.

3. The image forming apparatus according to claim 2, wherein each of the swing members is made of an electroconductive material.

4. The image forming apparatus according to claim 1, wherein the swing members swing when the swing members are pushed by the recording medium that is output by the output unit, and tip portions of the swing members are covered by the cover when the swing members are at rest under weights thereof before the swing members are pushed by the recording medium and swing.

5. The image forming apparatus according to claim 4, wherein each of the swing members is made of an electroconductive material.

6. The image forming apparatus according to claim 1, wherein each of the swing members is made of an electroconductive material.

7. The image forming apparatus according to claim 1, wherein each of the swing members is made of an electroconductive material.

8. The image forming apparatus according to claim 1, wherein downstream tip portions of the swing members in a recording medium conveyance direction lie upstream of the cover in the recording medium conveyance direction when the swing members are at rest under weights thereof before the swing members are pushed by the recording medium and swing.

* * * * *